US005082067A

United States Patent [19]

Tornqvist

[11] Patent Number: 5,082,067

[45] Date of Patent: Jan. 21, 1992

[54] APPARATUS WITH TWO END POSITIONS GENERATING A RECIPROCATING MOTION

[76] Inventor: Peter J. T. Tornqvist, Barkassvagen 11, S-181 35 Lidingo, Sweden

[21] Appl. No.: 555,418

[22] PCT Filed: Feb. 22, 1989

[86] PCT No.: PCT/SE89/00072

§ 371 Date: Sep. 14, 1990

§ 102(e) Date: Sep. 14, 1990

[87] PCT Pub. No.: WO89/07511

PCT Pub. Date: Aug. 24, 1989

[30] Foreign Application Priority Data

Feb. 22, 1988 [SE] Sweden ..... 8800608

[51] Int. Cl.[5] ..... B25D 9/04

[52] U.S. Cl. ..... 173/17; 173/134; 173/162.1

[58] Field of Search ..... 173/134, 128, 162.1, 173/16, 17, 139, 114, 131; 175/296, 299; 267/137

[56] References Cited

U.S. PATENT DOCUMENTS

| | | | |
|---|---|---|---|
| 526,342 | 9/1894 | Carlinet | 173/139 X |
| 3,792,740 | 2/1974 | Cooley | 173/139 X |
| 4,460,051 | 7/1984 | Widmer | 173/134 |
| 4,592,431 | 6/1986 | Tornqvist | 173/162.1 X |

FOREIGN PATENT DOCUMENTS

| | | |
|---|---|---|
| 366239 | 4/1974 | Sweden . |
| 7409351-9 | 12/1978 | Sweden . |
| 7603252-3 | 3/1979 | Sweden . |
| 7902873-4 | 2/1981 | Sweden . |
| 7800334-0 | 8/1982 | Sweden . |
| 8204044-5 | 7/1983 | Sweden . |

*Primary Examiner*—Douglas D. Watts
*Assistant Examiner*—C. Dexter
*Attorney, Agent, or Firm*—Frishauf Holtz, Goodman & Woodward

[57] ABSTRACT

An apparatus with two limit positions and generating a reciprocating motion, comprises a first moving part (4*a*, 4*b*) and a second moving part (16*a*, 16*b*) between which parts (4*a*, 4*b*; 16*a*, 16*b*) a pressurized drive medium (38*a*, 38*b*) such as compressed air, is disposed to simultaneously displace the moving parts (4*a*, 4*b*; 16*a*, 16*b*) in mutually opposite directions. At least the first moving part (4*a*, 4*b*) is actuated, by a constantly present force, for example by the pressure of the driving media (38*a*, 38*b*) applied on at least one surface of the first moving part (4*a*, 4*b*), in the forward direction under tensioning of an associated force accumulator (20*a*), for example a spring. The pressurized drive medium (38*a*, 38*b*) is also applied between the first and second moving parts (4*a*, 4*b*; 16*a*, 16*b*) such that the second moving part (16*a*, 16*b*) is disposed, in the forward direction, to tension an associated force accumulator (19*a*, 19*b*) under simultaneous cancelling of the load on the force accumulator (20*a*) associated with the first moving part (4*a*, 4*b*).

51 Claims, 1 Drawing Sheet

APPARATUS WITH TWO END POSITIONS GENERATING A RECIPROCATING MOTION

TECHNICAL FIELD

The present invention relates to an apparatus with two limit positions generating a reciprocating motion, the apparatus comprising a first moving part and a second moving part, between which parts a pressurized medium, appropriately compressed air, is arranged simultaneously to displace the moving parts in mutually opposite directions.

BACKGROUND ART

It is previously known in this art to employ two mutually displaceable masses or bodies for the purpose of reducing the vibrations generated in a tool. Examples of such prior-art technology are revealed in Swedish patent No. 7603252-3.

To some extent, such prior-art solutions have resulted in reduced vibrations at low loads, but the vibrations increase with greater loads. Moreover, such prior-art solutions suffer from the drawback that they consume unnecessarily large amounts of drive medium, partly because only the one moving part carries out useful work during its displacement, and partly because the drive medium is continually applied between the moving parts. While another prior-art solution, disclosed in Swedish patent No. 8204044-5, shows a supply valve, this valve is only shut off in conjunction with the one limit position, a certain reduction in the air consumption being hereby obtained as compared with the chisel device according to the first-mentioned Swedish patent. A further drawback inherent in the above-mentioned prior-art types of apparatus is that they are difficult to "creep-start" and that they undergo a major change in operational mode on contact with the workpiece which is to be processed, for instance the vibration level changes on impacts of varying power by the apparatus against the workpiece. In addition, the prior-art types of apparatus suffer from difficulties in providing the necessary stroke lengths and kinetic energies for specific requirements.

OBJECT OF THE INVENTION

The object of the present invention is to reduce or obviate the above-outlined drawbacks inherent in prior-art types of apparatus for generating a reciprocating motion.

SOLUTION

The object of the present invention will be attained if the apparatus mentioned by way of introduction is characterized in that at least the first moving part is actuated, by a constantly present force, for example in that the pressure of the drive medium is applied on at least one surface of the first moving part, in the forward direction under tensioning of an associated force accumulator, for instance a spring; and that the above-mentioned pressurized drive medium is applied between the first and second moving parts such that the second moving part is disposed, in the forward direction, to tension an associated force accumulator under simultaneous cancelling of the load on the force accumulator associated with the first moving part. A particularly advantageous embodiment of the present invention will be realized if the above-mentioned pressurized drive medium is arranged to be supplied intermittently between the above-mentioned moving parts solely in connection with the limit positions of the apparatus, preferably solely in connection with the one limit position, at which the above-mentioned first and second moving parts are positioned closest to one another, and if one or both of the moving parts are arranged, by cooperation, to release, in connection with at least the one limit position of the apparatus, a sealing member for the supply of the pressurized drive medium between the above-mentioned moving parts in connection with the one limit position of the apparatus.

BRIEF DESCRIPTION OF THE ACCOMPANYING DRAWINGS

The nature of the present invention and its aspects will be more readily understood from the following brief description of the accompanying drawings, and discussion relating thereto.

In the accompanying drawings:

FIG. 1 is a cross-section through an apparatus according to the present invention; and FIGS. 2 and 3 show further alternatives for tool sockets and mounts etc. In respect of FIG. 1, it should be observed that the apparatus according to FIG. 1, as well as the mounts according to FIGS. 2 and 3 show, above and below the centre line I—I respectively, different conceivable designs for different applications with varying advantages, as will be more readily apparent hereinbelow. Depending upon the desired mode of operation, field of use etc., appropriate detail solutions may be selected herefrom.

DESCRIPTION OF PREFERRED EMBODIMENT

Figure 1:
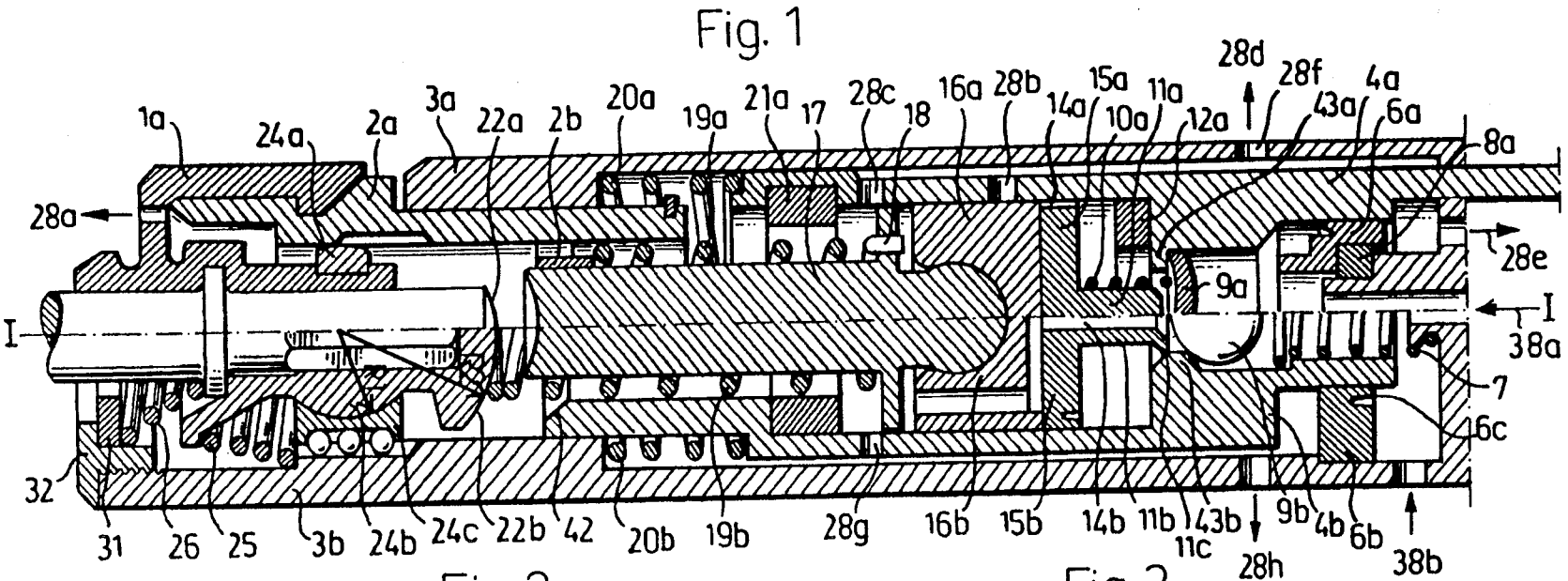

Referring to the drawings, the apparatus illustrated in FIG. 1 for generating a reciprocating motion comprises, as essential components, a first moving part 4*a* and a second moving part 16*a*, between which parts 4*a* and 16*a* a pressurized drive medium 38 from a pressure source operating either with constant or varying pressure, is supplied by means of one of the inlets which are marked with arrows showing directions in the apparatus. The first and second moving parts 4*a*, 16*a* are arranged exclusively on their movements in the forward direction—to the left in FIG. 1—to actuate and tension mutually separated but directly or indirectly mechanically interconnected force accumulators 20*a*, 19*a*, for example to compress springs 20*a*, 19*a* which, on tensioning, each generate a force directed against the forward direction of movement. As an alternative to the one force accumulator 20*a* in the form of a compression spring 20*a*, a draft spring 7 may be employed instead, as intimated to the right in FIG. 1. Naturally, other types of force accumulators could be employed, such as bellows accumulators, rubber hoses etc.

However, the first moving part 4*a* is, by means of a constantly present force, for example applied in that the pressure of the drive medium 38*a* is exercised on one surface of the first moving part 4*a*, pretensioned in the forward direction—to the left in FIG. 1—against the action of its associated force accumulator 20*a*. If desired or necessary, the second moving part 16*a* may also be correspondingly pretensioned in the forward direction in that, for example, the pressure of the drive medium 38*a* is also disposed to be applied on a surface (not shown) of the second moving part 16*a* against the action of its associated force accumulator 19*a*. As an alternative or supplementary measure, the above-mentioned tensioning force or forces may, of course, also be applied by a manner other than using the drive medium and surfaces, for example by means of one or more springs.

The second moving part 16*a* is reciprocatingly displaced by the drive medium in relation to and preferably in the first moving part 4*a* and in its displacement, energy and impulse transfer can be limited by abutments 21*a* and 12*a* fixedly disposed in the first moving part 4*a* or possibly in a casing 3*a* in a manner which is not shown on the drawings. The second moving part 16*a* is advantageously in its return direction, to the right in FIG. 1—designed with an upright 11*a* via, for example, a rigid or resilient body 15*a*, and the upright 11*a* may either be naturally resilient or be provided with a spring 10*a* and, in connection with its right-hand limit position seen in FIG. 1 in relation to the first moving part 4*a* is arranged intermittently and unstably to actuate (in the chosen example to open) an appropriately resilient sealing washer 9*a* which normally seals against a seat 43*a* in the first moving part 4*a* by the pressure of the drive medium. The pressurized drive medium which is comprised of gases or liquids, appropriately compressed air, will hereby be supplied for a brief period during the movement cycle, to that space which is defined by the first moving part 4*a* and the body 15*a* of the second moving part 16*a*, whereby the moving parts 4*a* and 16*a* are driven simultaneously by the pressure of the drive medium in opposite directions, the first moving part 4*a* moving to the right in FIG. 1 under simultaneous cancellation of the load on its associated force accumulator 20*a*, and the second moving part 16*a* moving to the left in FIG. 1, the second moving part 16*a* at this point simultaneously further tensioning its associated force accumulator 19*a*, a movement being generated in the forward direction, for example by an appropriately articulated piston rod 17 anchored in the second moving part 16*a*. The motion of the piston rod may in its turn be converted into useful work by means of a chisel end 22*a*.

The reaction forces which are applied by the two force accumulators 20*a* and 19*a* directly or indirectly on the casing 3*a* will hereby be alternatingly pulsating, while, on the other hand, the total of these reaction forces will remain constant substantially throughout the entire movement cycle. Since the total of these reaction forces essentially corresponds to undesired vibration in the casing 3*a*, the casing 3*a* will appear as being substantially vibration-free.

The force accumulator 19*a* (in this case a spring) may—but need not—be fixedly secured at its one end while simultaneously generating a resistance to torque, in an aperture disposed in an annular flange 18 of the piston rod 17 and, in its other end, engage directly or indirectly against the casing 3*a* by means of, for instance, a perforated flange to be in the detail 2*a*.

The detail 2*a* is rotary in relation to the casing 3*a* for the purpose of permitting twist adjustment of the working tool but may, if appropriate, also naturally be designed as an integral unit with the casing 3*a*. A displacement of the detail 2*a* executed in the return direction of the apparatus can be employed for tensioning the force accumulator 19*a* and thereby also the spring 10*a* of the upright 11*a* and raise the sealing washer 9*a* for supply of drive medium and starting the apparatus.

When the first and second moving parts 4*a* and 16*a* have—because of the pressure of the drive medium—moved a sufficient mutual distance apart, an outlet port 28*b* for the drive medium is exposed via the gap 14*a* between the outer edge of the annular body 15*a* and the first moving part 4*a*. As a result, the medium can then be caused to take different paths to run out into the atmosphere depending upon where discharge of the residual pressure of the drive medium is desired. For instance, the medium may be released rearwardly, to the right in FIG. 1, by means of the outlet 28*e*, upwardly according to FIG. 1, by means of the outlet 28*f*, forwardly, to the left in FIG. 1, by means of the channel 28*c*, via the gap between the flange 18 and the first moving part 4*a*, via apertures or gaps at the flange 2*b* and out through the outlet 28*a* in a manner which will be described in greater detail below.

The positively separating pressure of the medium between the first and second moving parts 4*a* and 16*a* will hereby have been substantially reduced, whereupon the return of the tensioned force accumulator 19*a* of the second moving part 16*a* will displace the second moving part 16*a* to the right in FIG. 1, at the same time as the pressure of the drive medium on the first moving part 4*a* strives to return the first moving part to the left in FIG. 1 because of an appropriately selected pressure surface on the first moving part 4*a*, this pressure surface acting in the forward direction. In its turn, the first moving part tensions its associated force accumulator 20*a* in the forward direction, to the left in FIG. 1. These counterdirected movements in the first and second moving parts 4*a* and 16*a* continue to that position where the upright 11*a*, whether resilient or rigid, once again raises the sealing washer 9*a*, whereby the pressure of the drive medium is reapplied between the first and second moving parts 4*a* and 16*a*, the cycle as described above being repeated.

As a result of the cycle of movement disclosed in the foregoing, there will be realized an apparatus which generates a reciprocating motion and which has extremely low vibration levels in the casing 3*a*, this casing constituting the outer casing of the apparatus and normally being held by the user of the apparatus.

By supplying different operating pressures, for example by varying the opening (not shown) of the inlet 38*a* for the supply of drive medium, the location and limit positions of the first and second moving parts 4*a* and 16*a* within the casing 3*a* may be varied. For example, a low supplied pressure of the drive medium will give a short displacement of the first moving part 4*a* in the forward direction and thereby a slight tensioning of its associated force accumulator 20*a*, while, on the other hand, a high pressure in the drive medium will give relatively longer displacement of the first moving part 4*a* in the forward direction and thereby a more powerful tensioning of the force accumulator 20*a*.

As a supplementary measure, the second moving part 16*a* may also be pretensioned in the forward direction by means, for example, of the pressure of the drive medium in that (not shown on the drawings) a surface of the second moving part 16*a* is exposed to the pressure of the drive medium in the forward direction, whereby its associated force accumulator 19*a* will also be tensioned in a manner corresponding to that which applies to the force accumulator 20*a*.

In the upper half of FIG. 1, a central inlet is shown for the drive medium 38*a*, and this central inlet may advantageously be somewhat movably secured via, for instance, a resilient ring 8*a* in order to reduce or eliminate the effect of eccentricity errors on the first moving part 4*a* and on the casing 3*a*.

Alternatively, the drive medium 38*b* may, for example, be supplied via a handle (not shown) which is downwardly directed in FIG. 1. In this case, the first moving part 4*b* as shown below the centre line I—I in FIG. 1, may be guided by the lip-shaped sealing 6*c* of an annular sealing wall 6*b* instead of being guided by the annular sealing wall 6*a* as shown above the centre line I—I.

The lower half of FIG. 1, below the centre line I—I, shows a number of variations on the embodiment illustrated above the centre line I—I in the same Figure. These variations will be discussed in greater detail below.

The resilient sealing washer 9*a* may advantageously be designed with a guide (not shown in FIG. 1) towards the part 4*a* if necessary, and may be replaced by a ball 9*b* which is round, conical or of similar appearance as is apparent from the lower half of FIG. 1 below the centre line I—I. As an alternative, the sealing washer 9*a* or the ball 9*b* may be provided with an extension corresponding to the upright 11*a*.

In the embodiment shown in the lower half of the drawing, the resilient abutment limiting device 12*a* has been replaced in that the body 15*b* is rendered resilient, in which event the inner surface of the first moving part 4*b* constitutes a direct abutment. As an alternative, the moving parts 4*a* and 16*a* may be instead mutually discrete and disposed one after the other in the same casing.

The solid or resilient upright 11*a* may be replaced by an upright 11*b* provided with a conduit 14*b*, the upright being advantageously provided with an annular lip seal 11*c* in its part furthermost to the right in FIG. 1. The purpose of this lip seal 11*c* (like the resilience of the upright 11*a* and 11*b*, respectively and the spring 10*a*) is to modify the time sequence on opening and closing of the valve function with a view to creating more distinct and delayed changes which result inter alia in lower consumption of drive medium. In this modified time sequence, discharge of residual drive medium is effected through the channel 14*b* and out.

In the embodiment shown above the centre line I—I in FIG. 1, a movement of the second moving part 16*a* is put into effect via the impact of the piston rod 17 against the end 22*a* of the chisel. Alternatively, the chisel and piston rod may constitute a single unit. As an alternative or supplement, a second movement may be put into effect from the first moving part 4*a* via, for example, an end thereof projecting out from the casing 3*a* as shown to the right in FIG. 1 above the outlet 28*e*. In the embodiment shown in the lower half of the drawing, a movement is put into effect from the second moving part 16*b* by means of the abutment of the piston rod 17 against a curved surface 22*b* on a chisel mount 24*b* which advantageously is tiltably journalled in a centre running through the centre line of the chisel mount, with a radius R1 which is adapted to the radius of curvature R2 of the curved surface 22*b* such that these radii coincide in the tilting centre of the chisel mount 24*b* for the purpose of permitting tilting of the chisel without transfer of lateral forces thence to the casing 3*a*, 3*b*, for example from a pivoting metal sheet. In this embodiment, the forward movement of the first moving part 4*b*—to the left in FIG. 1—is also put into effect to the tool in that its annular end surface 42 is adapted in form to the curved surface 22*b* of the chisel mount 24*b* and strikes against the surface 22*b*. As a result of this design, it is possible to utilize the forward movements of both the second moving part 16*b* and the first moving part 4*b* in one and the same direction, namely to the left in FIG. 1, even if the chisel is angularly tilted somewhat. In this latter design, the one force accumulator 20*b* works against an abutment in the casing 3*b* while, on the other hand, the second force accumulator 19*b* is shown as working against the curve surface 22*b* of the chisel mount 24*b*. Naturally, the force accumulator 19*b* may instead be directly connected to the casing 3*b* in a manner which is not shown in detail on the drawings.

The bearing cup 24*c* of the chisel mount 24*b* is advantageously ball or roller journalled with a certain clearance in the directions of movement in the casing 3*b* and may also generate a braking effect against twisting of the chisel, and also start the apparatus in analogy with a previously described embodiment.

Thanks to the ball and socket anchorage of the piston rod 17 in the second moving part 16*a*, 16*b*, any possible shearing forces generated by the chisel 22*a* or, if they are interconnected to a unit, from the chisel mount 24*b* will not strive to obliquely offset the second moving part 16*a*, 16*b*, whereby possibly increased friction and wear-on the parts 4*a*, 4*b* and 16*a*, 16*b* caused by oblique loading will be avoided.

In the embodiment shown in the lower half of FIG. 1, the chisel is held in place by a spring 26 by means of an advantageously resilient washer 31 with a large centre hole, the spring acting against a flange on the chisel. The chisel mount 24*b* is also retained by tension by means of a spring 25. The washer 31 is fixed in position by means of an end piece 32 for example screwed to the casing 3*b*. Discharge of residual medium may be effected via the space for the springs 25 and 26 and via the overdimensioned centre hole in the washer 31, for example for blowing off loosened particles, with the help of this pulsating residual medium from the drive medium, from that point being worked by the chisel.

In the embodiment illustrated above the centre line I—I in FIG. 1, the end piece 1*a* is instead made of a resilient material which may also serve as an anti-twist brake for the chisel. In this embodiment, depression of the chisel is required such that a portion 24*a* shown therein releases residual drive medium in order that the apparatus can start and, as the chisel is urged against the workpiece excessively, the outlet 28*a* may possibly also be arranged to be shut off correspondingly.

Figure 2:
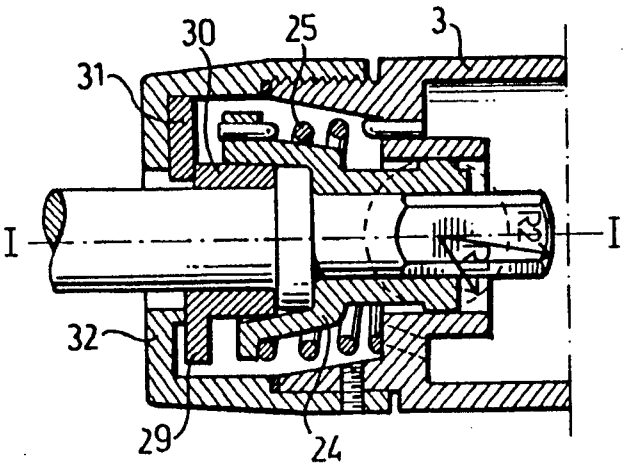

FIG. 2 illustrates alternative chisel mounts, in which the chisel mount 24 has been provided with a small spherical portion which is directly controlled by a cylindrical section of the casing 3. An advantageously pretensioned spring 25 with end stub shafts engaging in holes in the casing 3 and in the chisel mount 24 provide a braking action against twisting of the chisel. In the upper section of FIG. 2, two elements 30, 31' are shown, of which one or both may be resilient in order to provide spacing to the flange of the chisel and support against lateral loading, and also to provide a seal in the event that a chisel is not applied. In the lower half of FIG. 2, the elements 30, 31' have been replaced by one sole element 29 for providing space to the mounting of the chisel, sealing and support against lateral loading. The end piece 32' is removably secured to the casing 3 in a simple manner, by being threaded—as in the upper half of FIG. 2—or by a bayonet catch—as in the lower half of FIG. 2.

Figure 3:
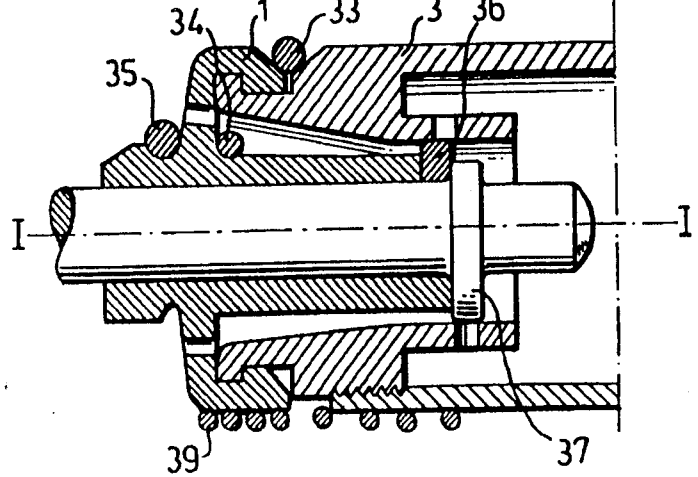

FIG. 3 shows yet further alternatives for chisel mounts, in which a resilient sleeve is designated 1 and constitutes a torque brake for the chisel and forms a spring in the direction of movement of the chisel so as not to transfer lateral forces from the chisel to the casing 3.

The locking springs shown in FIG. 3 positionally fix the chisel to the resilient sleeve 1 by means of the locking springs 34 and 35 and the resilient sleeve 1 to the casing 3 by means of the locking spring 33. These locking springs 33, 34, 35, being for instance in the form of O-rings, may readily be rolled off and on in the event of chisel change. In the embodiment according to the upper half of FIG. 3, a circular bearing bush 36 is required which may also constitute a release opener on depression of the chisel, analogous with the portion 24*a* according to FIG. 1.

In the embodiment according to the lower half of FIG. 3, the flange 37 of the chisel constitutes the above-mentioned release opener on chisel depression, and a locking spring 39 here fixes the resilient sleeve 1 in relation to the casing.

The present invention has been described above with reference to a number of different embodiments relating to an impact tool with a chisel. However, the apparatus according to the present invention is of general applicability and may be employed for most types of devices which require a reciprocating motion, and mention might be made, solely by way of example, of impact tools, hammer tools, filing machines, grinding and polishing machines, engraving tools etc. Hence, the present invention should not be considered as restricted to that described above and shown on the drawings, many modifications being conceivable without departing from the spirit and scope of the appended claims.

What we claim and desire to secure by Letters Patent is:

1. An apparatus generating a reciprocating motion, and having two limit positions, the apparatus comprising:

a first moving part (4*a*, 4*b*) and a second moving part (16*a*, 16*b*);

a pressurized drive medium (38), applied between said first and second moving parts (4*a*, 4*b*; 16*a*, 16*b*) to substantially simultaneously displace said moving parts (4*a*, 4*b*; 16*a*, 16*b*) in mutually opposite directions;

means for applying a constantly present force to at least said first moving part (4*a*, 4*b*) to actuate said first moving part (4*a*, 4*b*), in a forward direction;

a first force accumulator (20*a*) coupled to said first moving part and which is put under increased resilient force-producing loading responsive to actuation of said first moving part in the forward direction;

said pressurized drive medium (38) being applied between said first and second moving parts (4*a*, 4*b*; 16*a*, 16*b*) such that said second moving part (16*a*, 16*b*) is disposed, in said forward direction, to put an associated second force accumulator (19*a*, 19*b*) under increased force-producing loading and to substantially simultaneously put said first force accumulator (20*a*) under decreased resilient force-producing loading;

said first and second moving parts (4*a*, 4*b*; 16*a*, 16*b*) being located in a common casing (3*a*, 3*b*) against which said first and second force accumulators (20*a*, 20*b*; 19*a*, 19*b*) act at all times so as to always act as force accumulators during all movement of their respective associated first and second parts.

2. The apparatus of claim 1, wherein said first and second force accumulators (20*a*, 20*b*; 19*a*, 19*b*) each comprise a spring.

3. The apparatus of claim 2, comprising:

means for coupling a working tool to at least one (16*a*, 16*b*) of said moving parts; and wherein:

said spring of said second force accumulator (19*a*, 19*b*) being arranged yieldably to counteract a twisting of said working tool.

4. The apparatus of claim 3, wherein at least one of said spring force accumulators (19*a*, 19*b*; 20*a*, 20*b*) is disposed to be resiliently preloaded by being resiliently deformed by means of said working tool, such that an inlet (43*a*) for said drive medium (38) is not opened until after application of a force counteracting said resilient preloading.

5. The apparatus of claim 3, wherein said spring of said second force accumulator is fixedly secured via its ends in relation to its associated moving part and in relation to said casing (3*a*).

6. The apparatus of claim 2, wherein said pressurized drive medium (38) is arranged to be supplied intermittently between said moving parts (4*a*, 4*b*; 16*a*, 16*b*) solely in connection with the limit positions of the apparatus.

7. The apparatus of claim 6, wherein said pressurized drive medium (38) is arranged to be supplied intermittently between said moving parts (4*a*, 4*b*; 16*a*, 16*b*) solely in connection with a limit position at which said first and second moving parts (4*a*, 4*b*; 16*a*, 16*b*) are positioned closest to each other.

8. The apparatus of claim 2, wherein at least one of said moving parts (4*a*, 4*b*; 16*a*, 16*b*) is arranged by cooperation to release, in at least one limit position of the apparatus, a sealing member (9*a*, 9*b*) for supply of said pressurized drive medium (38) between said moving parts (4*a*, 4*b*; 16*a*, 16*b*) at said one limit position of said apparatus.

9. The apparatus of claim 2, wherein said force is substantially constant and substantially independent of the mutual positions of said moving parts (4*a*, 4*b*; 16*a*, 16*b*).

10. The apparatus of claim 2, further comprising:

a rod (17) pivotally secured by means of a ball and socket jointed end in at least one of said moving parts (16*a*, 16*b*);

said rod (17) comprising a working tool; and wherein at least one of said first moving part (4*a*, 4*b*) and said second moving part (16*a*, 16*b*) being arranged to abut against said rod upon forward movement of said first or second moving parts, said rod having a curved end surface (22*a*, 22*b*) cooperating with said moving part, said curved end surface having a center of radius of curvature (R2) which coincides with a center (RI) of angular tilt of a working tool.

11. The apparatus of claim 2, wherein said drive medium (38) is disposed to supply said constantly present force; and wherein the supply of pressure of said drive medium (38) is variable, by varying an opening of an inlet (38A) for supply of said drive medium (38).

12. The apparatus of claim 2, wherein said pressurized drive medium (38) comprises compressed air.

13. The apparatus of claim 2, wherein said first and second force accumulators directly act against said casing.

14. The apparatus of claim 2, wherein said first and second force accumulators indirectly act against said casing.

15. The apparatus of claim 1, wherein said pressurized drive medium (38) is arranged to be supplied intermittently between said moving parts (4a, 4b; 16a, 16b) solely in connection with the limit positions of the apparatus.

16. The apparatus of claim 15, wherein said pressurized drive medium (38) is arranged to be supplied intermittently between said moving parts (4a, 4b; 16a, 16b) solely in connection with a limit position at which said first and second moving parts (4a, 4b; 16a, 16b) are positioned closest to each other.

17. The apparatus of claim 15, wherein said force is substantially constant and substantially independent of the mutual positions of said moving parts (4a, 4b; 16a, 16b).

18. The apparatus of claim 1, wherein at least one of said moving parts (4a, 4b; 16a, 16b) is arranged by cooperation to release, in at least one limit position of the apparatus, a sealing member (9a, 9b) for supply of said pressurized drive medium (38) between said moving parts (4a, 4b; 16a, 16b) at said one limit position of said apparatus.

19. The apparatus of claim 1, wherein said force is substantially constant and substantially independent of the mutual positions of said moving parts (4a, 4b; 16a, 16b).

20. The apparatus of claim 1, comprising:

means for coupling a working tool to at least one (16a, 16b) of said moving parts; and wherein:

said second force accumulator (19a, 19b) comprises a spring (19a), said spring (19a) being arranged yieldably to counteract a twisting of said working tool.

21. The apparatus of claim 20, wherein said spring (19a) is fixedly secured via its ends in relation to its associated moving part and in relation to said casing (3a).

22. The apparatus of claim 1, further comprising:

a rod (17) pivotally secured by means of a ball and socket jointed end in at least one of said moving parts (16a, 16b);

said rod (17) comprising a working tool; and wherein at least one of said first moving part (4a, 4b) and said second moving part (16a, 16b) being arranged to abut against said rod upon forward movement of said first or second moving parts, said rod having a curved end surface (22a, 22b) cooperating with said moving part, said curved end surface having a center of radius of curvature (R2) which coincides with a center (RI) of angular tilt of a working tool.

23. The apparatus of claim 1, wherein said drive medium (38) is disposed to supply said constantly present force; and wherein the supply of pressure of said drive medium (38) is variable, by varying an opening of an inlet (38A) for supply of said drive medium (38).

24. The apparatus of claim 1, wherein said pressurized drive medium (38) comprises compressed air.

25. The apparatus of claim 1, wherein said first and second force accumulators directly act against said casing.

26. The apparatus of claim 1, wherein said first and second force accumulators indirectly act against said casing.

27. The apparatus of claim 1, wherein said resilient force-producing loading comprises resilient compression of said first and second force accumulators.

28. An apparatus generating a reciprocating motion, and having two limit positions, the apparatus comprising:

a first moving part (4a, 4b) and a second moving part (16a, 16b);

a pressurized drive medium (38), applied between said first and second moving parts (4a, 4b; 16a, 16b) to substantially simultaneously displace said moving parts (4a, 4b; 16a, 16b) in mutually opposite directions;

a first force accumulator (20a) coupled to said first moving part and which is put under increased resilient force-producing loading responsive to movement of said first moving part in a forward direction;

said pressurized drive medium (38) being applied between said first and second moving parts (4a, 4b; 16a, 16b) such that said second moving part (16a, 16b) is disposed, in a forward direction, to put an associated second force accumulator (19a, 19b) under increased resilient force-producing loading and to substantially simultaneously put said first force accumulator (20a) under decreased resilient force-producing loading;

said first and second moving parts (4a, 4b; 16a, 16b) being located in a common casing (3a, 3b) against which said first and second force accumulators (20a, 20b; 19a, 19b) act at all times so as to always act as force accumulators during all movement of their respective associated first and second parts.

29. The apparatus of claim 28, wherein said resilient force-producing loading comprises resilient compression of said first and second force accumulators.

30. The apparatus of claim 28, wherein said pressurized drive medium (38) is arranged to be supplied intermittently between said moving parts (4a, 4b; 16a, 16b) solely in connection with the limit positions of the apparatus.

31. The apparatus of claim 30, wherein said pressurized drive medium (38) is arranged to be supplied intermittently between said moving parts (4a, 4b; 16a, 16b) solely in connection with a limit position at which said first and second moving parts (4a, 4b; 16a, 16b) are positioned closest to each other.

32. The apparatus of claim 28, wherein at least one of said moving parts (4a, 4b; 16a, 16b) is arranged by cooperation to release, in at least one limit position of the apparatus, a sealing member (9a, 9b) for supply of said pressurized drive medium (38) between said moving parts (4a, 4b; 16a, 16b) at said one limit position of said apparatus.

33. The apparatus of claim 28, wherein said force is substantially constant and substantially independent of the mutual positions of said moving parts (4a, 4b; 16a, 16b).

34. The apparatus of claim 28, comprising:

means for coupling a working tool to at least one (16a, 16b) of said moving parts; and wherein:

said second force accumulator (19a, 19b) comprises a spring (19a), said spring (19a) being arranged yieldably to counteract a twisting of said working tool.

35. The apparatus of claim 34, wherein said spring (19a) is fixedly secured via its ends in relation to its associated moving part and in relation to said casing (3a).

36. The apparatus of claim 28, further comprising:

a rod (17) pivotally secured by means of a ball and socket jointed end in at least one of said moving parts (16a, 16b);

said rod (17) comprising a working tool; and wherein at least one of said first moving part (4*a*, 4*b*) and said second moving part (16*a*, 16*b*) being arranged to abut against said rod upon forward movement of said first or second moving parts, said rod having a curved end surface (22*a*, 22*b*) cooperating with said moving part, said curved end surface having a center of radius of curvature (R2) which coincides with a center (R1) of angular tilt of a working tool.

37. The apparatus of claim 28, wherein said drive medium (38) is disposed to supply said constantly present force; and wherein the supply of pressure of said drive medium (38) is variable, by varying an opening of an inlet (38A) for supply of said drive medium (38).

38. The apparatus of claim 28, wherein said pressurized drive medium (38) comprises compressed air.

39. The apparatus of claim 28, wherein said first and second force accumulators directly act against said casing.

40. The apparatus of claim 28, wherein said first and second force accumulators indirectly act against said casing.

41. The apparatus of claim 28, wherein said first and second force accumulators (20*a*, 20*b*; 19*a*, 19*b*) each comprise a spring.

42. The apparatus of claim 41, wherein said pressurized drive medium (38) is arranged to be supplied intermittently between said moving parts (4*a*, 4*b*; 16*a*, 16*b*) solely in connection with the limit positions of the apparatus.

43. The apparatus of claim 42, wherein said pressurized drive medium (38) is arranged to be supplied intermittently between said moving parts (4*a*, 4*b*; 16*a*, 16*b*) solely in connection with a limit position at which said first and second moving parts (4*a*, 4*b*; 16*a*, 16*b*) are positioned closest to each other.

44. The apparatus of claim 41, wherein at least one of said moving parts (4*a*, 4*b*; 16*a*, 16*b*) is arranged by cooperation to release, in at least one limit position of the apparatus, a sealing member (9*a*, 9*b*) for supply of said pressurized drive medium (38) between said moving parts (4*a*, 4*b*; 16*a*, 16*b*) at said one limit position of said apparatus.

45. The apparatus of claim 41, comprising:

means for coupling a working tool to at least one (16*a*, 16*b*) of said moving parts; and wherein:

said spring of said second force accumulator (19*a*, 19*b*) being arranged yieldably to counteract a twisting of said working tool.

46. The apparatus of claim 45, wherein said spring of said second force accumulator is fixedly secured via its ends in relation to its associated moving part and in relation to said casing (3*a*).

47. The apparatus of claim 41, further comprising:

a rod (17) pivotally secured by means of a ball and socket jointed end in at least one of said moving parts (16*a*, 16*b*);

said rod (17) comprising a working tool; and wherein at least one of said first moving part (4*a*, 4*b*) and said second moving part (16*a*, 16*b*) being arranged to abut against said rod upon forward movement of said first or second moving parts, said rod having a curved end surface (22*a*, 22*b*) cooperating with said moving part, said curved end surface having a center of radius of curvature (R2) which coincides with a center (R1) of angular tilt of a working tool.

48. The apparatus of claim 41, wherein said drive medium (38) is disposed to supply said constantly present force; and wherein the supply of pressure of said drive medium (38) is variable, by varying an opening of an inlet (38A) for supply of said drive medium (38).

49. The apparatus of claim 41, wherein said pressurized drive medium (38) comprises compressed air.

50. The apparatus of claim 41, wherein said first and second force accumulators directly act against said casing.

51. The apparatus of claim 41, wherein said first and second force accumulators indirectly act against said casing.

* * * * *